US005400042A

United States Patent [19]

Tulintseff

[11] Patent Number: 5,400,042

[45] Date of Patent: Mar. 21, 1995

[54] DUAL FREQUENCY, DUAL POLARIZED, MULTI-LAYERED MICROSTRIP SLOT AND DIPOLE ARRAY ANTENNA

[75] Inventor: Ann N. Tulintseff, Pasadena, Calif.

[73] Assignee: California Institute of Technology, Pasadena, Calif.

[21] Appl. No.: 983,436

[22] Filed: Dec. 3, 1992

[51] Int. Cl.[6] ..... H01Q 21/00

[52] U.S. Cl. ..... 343/727; 343/770; 343/793; 343/853

[58] Field of Search ..... 343/725, 727, 700 MS, 343/767, 770, 853, 793, 794

[56] References Cited

U.S. PATENT DOCUMENTS

| | | | |
|---|---|---|---|
| 3,747,114 | 7/1973 | Shyhalla | 343/853 |
| 4,040,060 | 8/1977 | Kaloi | 343/700 MS |
| 4,054,874 | 10/1977 | Oltman, Jr. | 343/797 |
| 4,922,263 | 5/1990 | Dubost et al. | 343/700 MS |
| 4,926,189 | 5/1990 | Zaghloul et al. | 343/700 MS |
| 4,929,959 | 5/1990 | Sorbello et al. | 343/700 MS |
| 5,038,151 | 8/1991 | Kaminski | 343/727 |

OTHER PUBLICATIONS

Densmore et al., Commercial Applications Of The Acts Mobile Terminal Millimeter-Wave Antennas, Technology 2001, The Second National Technology Transfer Conference and Exhibition, Dec. 3-5, 1991, pp. 47-51.

Densmore et al., Two K/Ka-BAND Mechanically Steered, Land-Mobile Antennas For The NASA Acts Mobile Terminal, CIT Patent Office, pp. 1-9 and FIGS. 1-13.

*Primary Examiner*—Donald Hajec
*Assistant Examiner*—Tan Ho
*Attorney, Agent, or Firm*—Fish & Richardson

[57] ABSTRACT

An antenna array system is disclosed which uses subarrays of slots and subarrays of dipoles on separate planes. The slots and dipoles respectively are interleaved, which is to say there is minimal overlap between them. Each subarray includes a microstrip transmission line and a plurality of elements extending perpendicular thereto. The dipoles form the transmission elements and the slots form the receive elements. The plane in which the slots are formed also forms a ground plane for the dipoles—hence the feed to the dipole is on the opposite side of this ground plane as the feed to the slots. HPAs are located adjacent the dipoles on one side of the substrate and LNAs are located adjacent the slots on the other side of the substrate. The dipoles and slots are tuned by setting different offsets between each element and the microstrip transmission line.

29 Claims, 4 Drawing Sheets

DUAL FREQUENCY, DUAL POLARIZED, MULTI-LAYERED MICROSTRIP SLOT AND DIPOLE ARRAY ANTENNA

ORIGIN OF INVENTION

The work described herein was made in the performance of work under a NASA contract and is subject to the provisions of Public Law 96-517 (35 U.S.C. 202) in which the contractor has elected to retain title.

The present defines a novel antenna system which uses separate slot and dipole arrays in a multi-layered arrangement.

BACKGROUND AND SUMMARY OF THE INVENTION

Antenna design always requires a trade-off. Usually a larger and more expensive antenna will provide better operational performance. An antenna can be made smaller at the expense of higher cost, or at the expense of decreased performance. The present invention provides a small and potentially inexpensive antenna with excellent performance.

The specific application intended for the antenna of the present invention is the so-called Advanced Communication Technology satellite ("ACTS") and Advanced Mobile Terminal ("AMT") made by NASA's Jet Propulsion Laboratory. This system is intended to provide voice data and video communication from a mobile vehicle via a geostationary ACTS satellite operating using the K and Ka band frequencies. A critical component of the AMT is its antenna system which must establish and maintain the basic RF link with the satellite.

The ACTS/AMT system will initially provide a demonstration of voice, fax and compressed video transmitted from a van or car travelling along roads and highways to a geostationary satellite. A two-way communication is envisioned between the vehicle and the first location, to the ACTS satellite and to a base station in a second location. The antenna must have a sufficiently wide elevation coverage so that only azimuthal tracking is required.

The specific requirements of the system require a low-profile, compact antenna array with approximately 22 dBi gain that receives vertical polarization at 20 GHz and transmits horizontal polarization at 30 GHz.

The antenna of the present invention provides a novel approach to meeting these requirements by using a multi-layered/interleaved array antenna of microstrips, slots and dipoles. A first planar array includes series-fed linear arrays of slots and a second planar array includes series-fed linear arrays of dipoles. Each of the arrays is formed of elements that are transversely coupled to a microstrip transmission line. The dipole and slot radiating elements have similar radiation patterns but radiate orthogonal polarizations.

More specifically, the antenna of the present invention includes a first layer including a receive array and a second layer including a transmit array. Each of the arrays include a plurality of subarrays; each subarray formed from a layer of separated antenna elements and a microstrip transmission line layer coupling together the antenna elements. The subarrays collectively form a plane of series-fed-type linear arrays. Different aspects of the elements relative to the microstrip transmission line can be modified in order to change various characteristics of the antenna. According to one particular aspect of the antenna, one of the layers is used as the ground plane for the other of the layers.

BRIEF DESCRIPTION OF THE DRAWINGS

These and other aspects of the invention will now be described in detail with respect to the accompanying drawings wherein.

DESCRIPTION OF THE PREFERRED EMBODIMENTS

Figure 1:
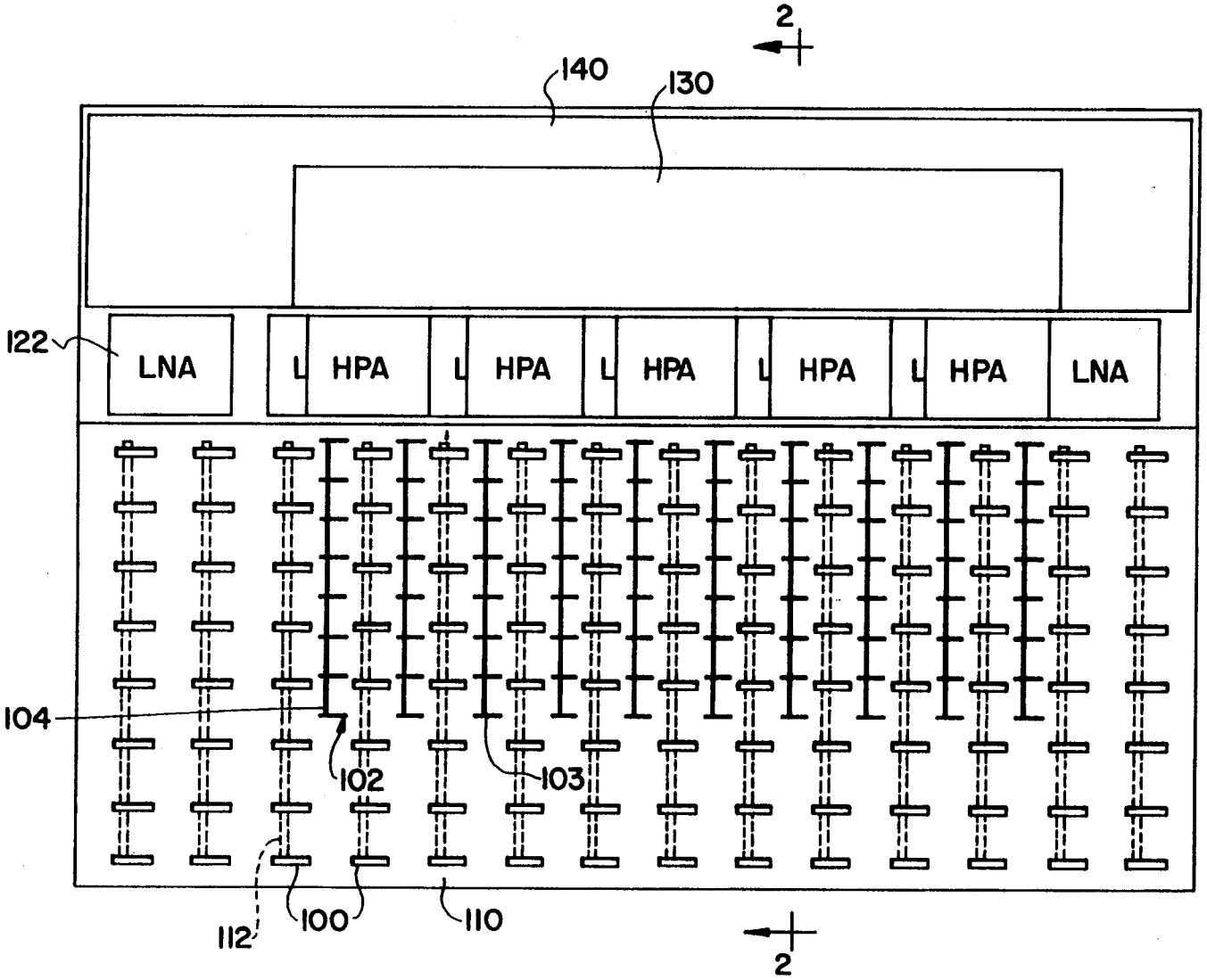
FIG. 1 shows a planar view of an active antenna array showing all of the layers in plane view.
Figure 2:
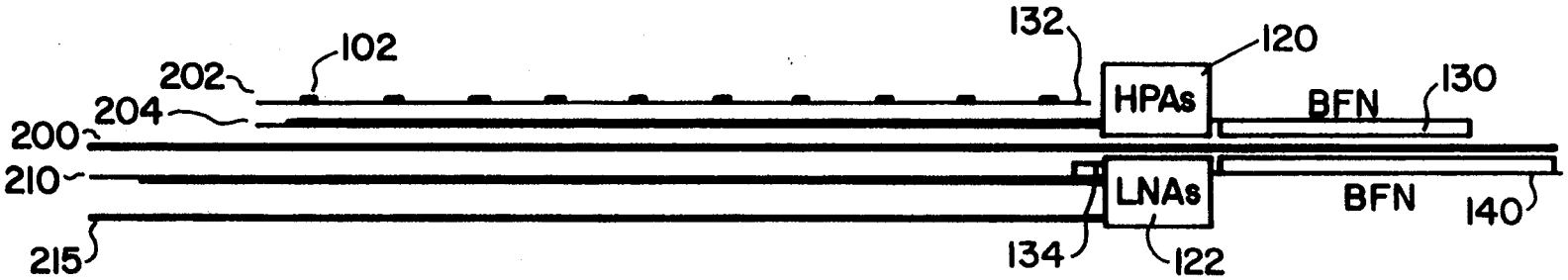
FIG. 2 shows a cross-sectional of the layers forming the antenna along the line 2—2 in FIG. 1.

The antenna system forming the preferred embodiment of the present invention is shown in FIG. 1. Its cross section along the line 2—2 is shown in FIG. 2. In brief, the antenna of the preferred embodiment is a dual-frequency antenna intended to receive vertical polarization at 20 GHz and to transmit horizontal polarization at 30 GHz. The antenna uses a multi-layered arrangement with different elements on different layers. Slot elements 100 are on a first layer 200, and the dipole elements 102 are on a second layer 202, overlying (with respect to the intended direction of mounting of the antenna) the first layer 200. The two layers form distinct and spaced planes.

The preferred embodiment transmits using a planar array of series-fed-type linear subarrays of electromagnetically-coupled microstrip dipole elements 102. A plurality of elements 102 on layer 202 are transversely coupled to a microstrip transmission line 104 on layer 204. Each of the dipole elements 102 is identical or nearly identical according to the preferred embodiment, although non-identical elements could alternately be used. For example, each of the dipole arrays could be formed as a Yagi type antenna, or any other type array antenna.

The desired power distribution along each linear array is set by offsetting each dipole element 102 with respect to the transmission line 104. FIG. 1 shows the use of ten dipole radiating subarrays for the transmit array, one of the elements being representatively shown by the reference number 102. It should be understood that any number of such dipole subarrays could be alternately used.

The receive array includes a plurality of series-fed-type linear subarrays of slot elements 100. Each linear subarray 110 includes a plurality of slots 100 forming layer 200, transversely coupled to a microstrip transmission line 112 forming layer 210.

The first and second sets of subarrays are interleaved, which is to say looking from the top as in FIG. 1, each dipole subarray is between two adjacent slot subarrays.

The slot subarrays are between two adjacent dipole subarrays. This interleaving helps to reduce the amount of interference between the transmit and receive arrays.

The preferred embodiment uses the slotted plane 200, on which the slot radiating elements are formed, as one of the ground planes for the transmit array on layers 202 and 204. The receive array is backed by a ground plane layer 215 approximately a quarter wavelength from the slot element layer 200. Vertical shorting pins may be mounted on layer 215 to reduce undesired cavity-mode wave propagation.

Figure 5:
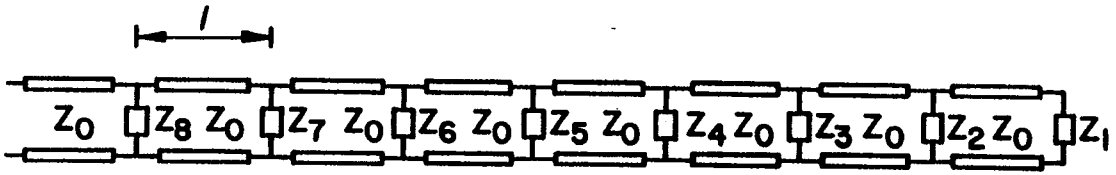
Figure 6:
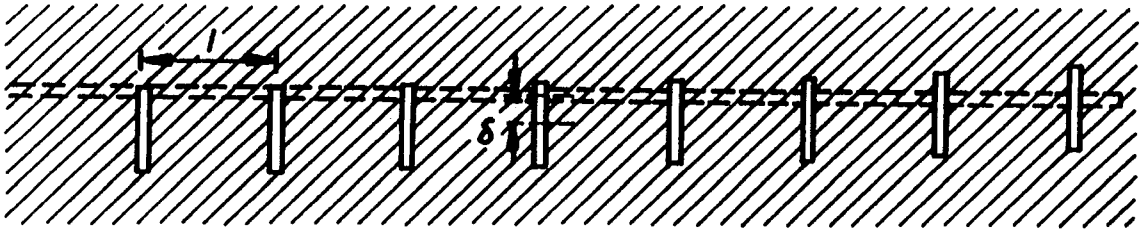
FIGS. 6 and 7 show the slot subarray and its equivalent circuit, respectively.

Each linear subarray is optimized by selecting the offset of each element relative to the transmission line to achieve the proper power distribution. In short, each transversely coupled electromagnetically coupled microstrip dipole is modeled as a shunt impedance loading the microstrip transmission line as shown in FIG. 5. Each transversely coupled slot dipole is modeled as a series impedance loading the microstrip transmission line as shown in FIG. 6. The specific optimization will be discussed in more detail herein.

The preferred embodiment uses solid state monolithic microwave integrated circuits ("MMIC") high power amplifiers ("HPAs") representatively shown by element 120, and MMIC low-noise amplifiers ("LNAs") 122. A plurality of HPAs 120 are mounted on the antenna, on a top side of the ground plane 200 (which forms the slotted elements) near the dipole radiating elements and on the same side thereof as shown in FIG. 2. Each HPA is preferably coupled to a single associated dipole array through feed 132. For example, HPA 120 is coupled only to array 102.

Similarly, each LNA 122 is mounted on a bottom side of ground plane 200, and is coupled to a single array 110 through feed 134. Integration of the MMIC amplifying elements onto the plane forming the antenna array itself minimizes the transmission line length between the amplifiers and the antenna elements. This keeps the losses low and the antenna efficiency and sensitivity high. The direct combination of one amplifier module to one radiating subarray allows for total signal amplification to be divided among the subarrays. This allows, for example, HPA 120 to provide only a fraction of the total transmitted power for the entire transmit array. In the preferred embodiment, each HPA must provide only approximately 0.1 watts, but of course the specific power depends on the requirements.

Alternatively, the preferred embodiment may eliminate the MMIC amplifiers (HPAs or LNAs or both) and be used in a passive manner.

Definition of Terms.

Prior to further discussion, a definition of the terms used throughout this specification will be provided.

An antenna element refers to one separated element of the antenna.

A subarray, or linear array, is formed by a series of antenna elements as coupled together by the respective transmission lines. For example, element 102 is one subarray, element 103 is another subarray, element 110 is a third subarray, etc. The subarrays can be further characterized as being either a transmit subarray such as 102, also called a dipole subarray or receive subarrays, also called slot subarrays, shown as 110, for example.

The amplifiers used according to the present invention include HPAs and LNAs. The term amplifiers is intended to be generic to both the transmit HPAs and the receive LNAs.

A combination of one HPA connected to one antenna subarray is called herein an amplified subarray. The entire set of dipole subarrays together form the transmit array. Similarly, the entire set of slot radiating elements together form the receive array.

In general, an active array antenna refers to any array antenna in which each element or subarray is associated with active, or nonlinear, components such as amplifiers or phase shifters. Typical active arrays use electronic scanning capabilities and are called phased arrays. However, electronically steerable antennae use a relatively large number of extremely expensive components. Hence the antenna of the present invention trades off the ability of unlimited steering by providing, at a lower cost, a main beam which is fixed in elevation but mechanically steered in azimuth.

In order to reduce costs, a number of relatively small power amplifiers are provided according to the present invention, one amplifier being associated with each antenna subarray. A choice of different subarrays can therefore be made depending on the direction of the main beam and the loss considerations. Fixed beam scanning can be accomplished by a progressive phase shift, related to the desired scan angle, among the array elements.

Each antenna also includes a transmit feed network 130 and a receive feed network 140. The feed networks are required for both the transmit and receive arrays to divide/combine the input/output power among the linear arrays. A series-type divider, while suitable for passive array operation, has proved undesirable for this active array application, since it does not provide isolation among the subarrays. If one amplifier were to fail, the resultant impedance change could be severe enough to cause damage to the other amplifiers.

Figure 3B:
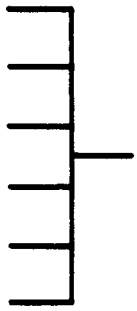
FIGS. 3A and 3B show the preferred feed configuration of the feed network.
Figure 3A:
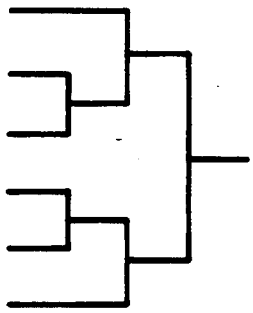

A corporate-type beam forming network using power dividing hybrids is shown in FIG. 3A. This uses so-called Wilkinson power dividers and provides isolation among the active linear arrays. The amplifiers are formed from MMIC packages of commercially available types but may be fully integrated with the fabrication of the arrays. Typically these amplifiers have a phase variation of $\pm 5\%$ and an amplitude variation of $\pm 1$ dB.

The MMIC amplifier is preferably fed to the linear array at the end or ends of each subarray.

Both the dipoles and slots are offset to achieve the proper power distribution.

The stacked configuration of the system is shown in FIG. 2, which as includes a top layer 202 including dipole elements 102. A second layer 204 is directly below layer 202 and includes the transmission line elements 104 which extend in a transverse direction to the direction of the microstrip dipoles. The slotted ground plane 200 is below the transmission line layer 204 and includes slots. A second layer of transmission lines for the slots is embodied as layer 210, which includes second transmission lines. A second ground plane 215 forms the final layer.

The HPAs 120 and LNAs 122 are shown on the proper respective sides, as are the transmit and receive feed networks 130 and 140 respectively.

The feeds to the dipoles are shown as element 132 and feed to the slots are shown as 134. Moreover, because the feed lines are on opposite sides of the ground plane 200, coupling of surface waves is minimized.

Figure 4:
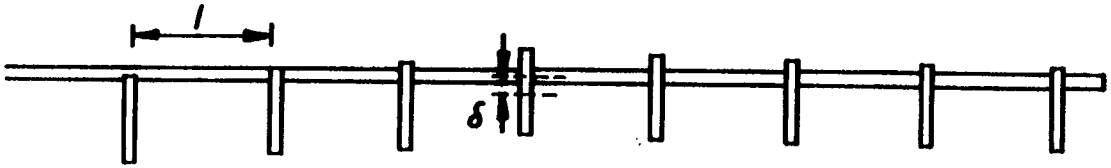
FIGS. 4 and 5 respectively show a dipole subarray according to the present invention and the equivalent circuit modeling this dipole subarray.
Figure 8:
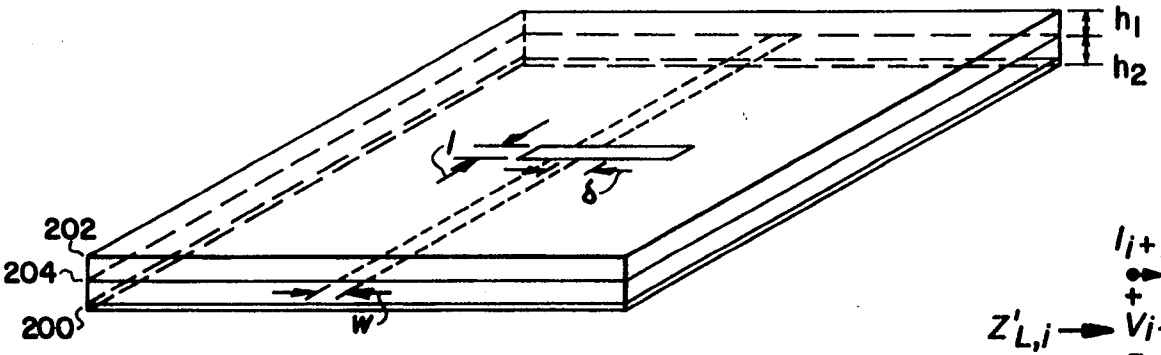
FIG. 8 shows the layers and their arrangement for the dipole elements.

A basic dipole subarray is shown in FIG. 4. The basic dipole array includes dipole element 102 and microstrip transmission line shown in FIG. 8. The offset $\delta$ is defined as the distance between the center of the microstrip transmission line 104 and the center 502 of the dipole element 102. Each offset for each element can be different.

Preferably, each dipole element is of approximately the same length, in the preferred embodiment approximately half a wavelength in length L and less than L/20 in width t. The offset, according to the preferred embodiment, varies between 0.1 L to 0.7 L. The system is modeled according to the equivalent circuit of FIG. 5, where the normalized resistance (with respect to the transmission line characteristic impedance) and the resonant frequency both as a function of offset can be obtained theoretically or experimentally.

Figure 9:
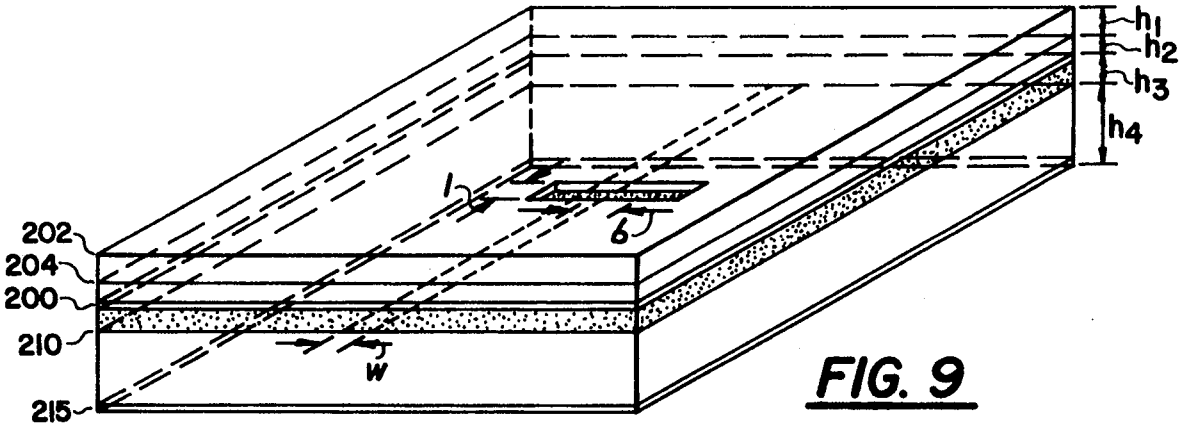
FIG. 9 shows the layers and arrangment for the slot elements.

The basic slot subarray is shown in FIG. 6. The basic slot array includes slot element 100 and transmission line 112 as shown in FIG. 9. The offset $\delta$ is defined as the distance between the center of the microstrip transmission line 112 and the center 500 of the slot element 100. Each offset for each element can different.

Preferably, each slot element is of approximately the same length, in the preferred embodiment approximately half a wavelength in length L and less than L/20 in width t. The offset, according to the preferred embodiment, varies between 0.3 L to 0.7 L. The system is modeled according to the equivalent circuit of FIG. 7, where the normalized resistance and resonant frequency both as a function of offset can be obtained either theoretically or experimentally.

Linear Array Design

To achieve a scanned beam $\theta_0$ measured off broadside, or normal, to the antenna, the following phase relationship between the slot and dipole radiating elements in the elevation direction, as shown in FIG. 1, should be satisfied $$\psi = \pm 2\pi \frac{d}{\lambda_0} \sin\theta_0 \pm 2m\pi \quad m \text{ an integer}$$

where d is the spacing between elements and $\lambda_0$ is the free space wavelength.

For some series-fed linear arrays, the desired phase distribution among the elements may be obtained simply by adjusting the path length of the interconnecting transmission lines to the appropriate length. Described below are the required path lengths needed to obtain a beam at scan angle $\theta_0$.

Consider a symmetrically fed linear array where the spacing between elements is d and the length of the interconnecting transmission line is $l \geqq d$.

To direct the main beam at the proper angle, the phase (using $e^{j\omega t}$ time dependence) must satisfy $$\Psi = -Bl = \pm k_0 d \sin\theta_0 = 2m\pi m \text{ an integer}$$

where $\beta = k_0\sqrt{\epsilon_{r,eff}}$, $k_0 = 2\pi/\lambda_0$, and $e_{r,eff}$ is the effective dielectric constant. Therefore, the path length of the interconnecting line must satisfy $$\sqrt{\epsilon_{r,eff}}\ \frac{l}{\lambda_0} = \mp \frac{d}{\lambda_0} \sin\theta_0 + m$$

To minimize E, i.e., minimize line loss, we solve the above equation when l=d to obtain $$\frac{l}{\lambda_0} = \frac{m}{\sqrt{\epsilon_{r,eff} \mp \sin\theta_0}}$$

The choice of sign in the above equation relates to which excitation end of the linear array is used to obtain the desired elevation beam.

Dipole Linear Array Design

The transmit antenna has linear arrays of series-fed-type dipoles electromagnetically coupled to a microstrip transmission line. Such a linear array, having $N_E$ dipole elements, is shown in FIG. 4.

Figure 7:
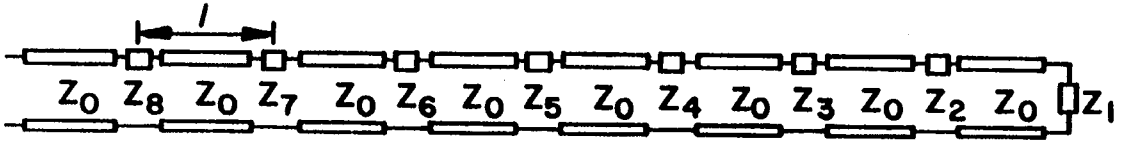

In an equivalent circuit model, each dipole i represents a shunt impedance, $Z_i = R_i + jX_i$, to the transmission line as shown in FIG. 7, where $Z_i$ is a function of the dipole offset, length, and width. It is desirable to operate each dipole at resonance, such that $X_i = 0$.

Figure 10:
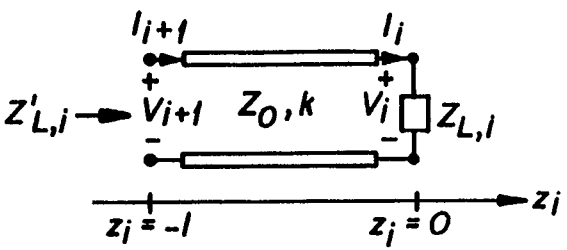
FIG. 10 shows an equivalent circuit to be used in modeling the RF characteristics.

A unit cell of the array equivalent circuit may be defined as shown in FIG. 10.

The transmission line of length l is characterized by its characteristic impedance $Z_0$ and its propagation constant k where $$k = \sqrt{\epsilon_{r,eff}}\, k_0 - j\alpha$$

$k_0 = 2\pi/\lambda_0$ is the free space wavenumber, $\lambda_0$ is the free space wavelength, $e_{r,eff}$ is the effective dielectric constant, and $\alpha$ is the attenuation constant.

The voltage and current on the transmission line of the unit cell are given by $$V(z_i) = V_{i+}e^{-jkz_i}[1 + \Gamma_{L,i}e^{j2kz_i}]$$

$$Z_0 I(z_i) = V_{i+}e^{-jkz_i}[1 - \Gamma_{L,i}e^{j2kz_i}]$$

where $$\Gamma_{L,i} = \frac{Z_{L,i} - Z_0}{Z_{L,i} + Z_0}$$

and $$Z_{L,i} = Z_i \,||\, Z'_{L,i-1}$$

with $$Z'_{L,i-1} = \frac{Z_{L,i-1} + jZ_0 \tan kl}{jZ_{L,i-1} \tan kl + Z_0} Z_0$$

We obtain the ratio of $V_{i+1}/V_i$ $$\frac{V_{i+1}}{V_i} = \frac{V(z_i = -l)}{V(z_i = 0)} = \frac{1 + \Gamma_{L,i}e^{-j2kl}}{1 + \Gamma_{L,i}} e^{jkl}$$

Note that the above is simply a recursive expression to obtain the voltage at successive points along the array.

The power dissipated in each dipole radiator is given by $$P_i = \frac{1|V_i|^2}{2R_i}$$

A recursive expression for the dipole resistances $R_i$ is given by $$R_i = \frac{1|V_i|^2}{2P_i} = \frac{1|V_{i-1}|^2|1 + \Gamma_{L,i-1}e^{-j2kl}|^2}{2P_i|1 + \Gamma_{L,1-1}|^2}$$

Therefore, for a given amplitude distribution, $\sqrt{P_i}$ ($i=1,2,\ldots,N_e$), a given transmission line length kl, $R_1$, and $V_1$, the resonant resistances $R_i$ are given by the above expression. For $\theta_0 \neq O$, $R_1 = Z_0$.

Once the desired resonant resistances $R_i$ are determined, design of the linear subarray is accomplished using design curves of resonant resistance and resonant frequency both as a function of offset, obtained either theoretically or experimentally.

Slot Linear Array Design

The receive antenna consists of linear arrays of series-fed-type slots transversely coupled to a microstrip transmission line. Such a linear array is shown in FIG. 6.

In an equivalent circuit model, ignoring mutual coupling between slot elements, each slot i represents a series impedance, $Z_i = R_i + jX_i$, to the transmission line, as shown in FIG. 7, where $Z_i$ is a function of the slot offset, length, and width. It is desirable to operate each slot at resonance, such that $X_i = 0$.

A unit cell of the array equivalent circuit may be defined as shown in FIG. 10.

Similar to the dipole case, the voltage and current on the transmission line of the unit cell are given by $$V(z_i) = V_{i+}e^{-jkzi}[1 + \Gamma_{L,i}e^{j2kzi}]$$

$$Z_0I(z_i) = V_{i+}e^{-jkzi}[1 - \Gamma_{L,i}e^{j2kzi}]$$

where $$\Gamma_{L,i} = \frac{Z_{L,i} - Z_0}{Z_{L,i} + Z_0}.$$

and $$Z_{L,i} = Z_i + Z'_{L,i-1}$$

with $$Z'_{L,i-1} = \frac{Z'_{L,i-1} + jZ_0\tan kl}{jZ_{L,i-1}\tan kl + Z_0} Z_0$$

We obtain the ratio $I_{i+1}/I_i$ as $$\frac{I_{i+1}}{I_i} = \frac{I(z_i = -l)}{I(z_i = 0)} = \frac{[1 - \Gamma_{L,i}e^{-j2kl}]}{[1 - \Gamma_{L,i}]} e^{jkl}$$

Note that the above is simply a recursive expression to obtain the current at successive points along the array.

The power dissipated in each slot radiator is given by $$P_i = \tfrac{1}{2}|I_i|^2R_i$$

A recursive expression for the slot resistances $R_i$ is given by $$R_i = \frac{2P_i}{|I_i|^2} = \frac{2P_i|1 - \Gamma_{L,i-1}|^2}{|I_{i-1}|^2|1 - \Gamma_{L,i-1}e^{-j2kl}|^2}$$

Therefore, for a given amplitude distribution, $\sqrt{P_i}$ ($i=1,2,\ldots,N_E$), a given transmission line length kl, $R_1$, and $I_1$, the resonant resistances $R_i$ are given by the above expression. For $\theta_0 \neq 0$, $R_1 = Z_0$.

Once the desired resonant resistances $R_i$ are determined, design of the linear subarray is accomplished using design curves of resonant resistance and resonant frequency both as a function of offset, obtained either theoretically or experimentally.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed is:

1. An antenna system comprising:

a transmitting portion, comprising:

a first planar layer defining a plane having x and y directions;

a first set of dipole subarrays, on said first planar layer, comprising a plurality of dipole elements, each said dipole subarray extending from a first x coordinate relative to a reference to a second x coordinate;

a plurality of high power amplifiers, one high power amplifier connected to each said dipole subarray; and a feed network, dividing total power to be transmitted among said high power amplifiers; and a receiver portion, comprising:

a second planar layer parallel to said first planar layer, having said x and y directions;

a plurality of slot subarrays, on said second planar layer, interleaved with said dipole subarrays, so that each slot subarray extends from a third x coordinate relative to said reference to a fourth x coordinate, wherein no center point of third and fourth coordinates is the same as any center point of first and second coordinates;

a plurality of low noise amplifiers, one low noise amplifier connected to each slot subarray; and a feed network, recombining power received by said slot subarray.

2. An antenna system as in claim 1 wherein said slot antenna subarrays are vertically polarized and said dipole antenna subarrays are horizontally polarized.

3. A system as in claim 1 wherein said slot antenna subarrays are formed on a first layer, and said dipole antenna subarrays are formed on a second layer separate from said first layer.

4. An antenna as in claim 3 further comprising a substrate on which said slot antenna subarrays are formed, which forms a ground plane for said dipole antenna subarrays.

5. An antenna as in claim 4 wherein each said subarray comprises a plurality of elements and a transmission line extending in a direction transverse to said plurality of elements.

6. The system as in claim 5 wherein each said transmission line is on a first sublayer, and each said element is on a second sublayer separate from said first sublayer.

7. A multiplanar slot and dipole antenna, comprising:

a first plane of electrically conductive material, formed of a substantially flat surface with a plurality of slots therein, each said slot formed from a hole in said first plane, said slots arranged into a plurality of slot linear subarrays, all of said slot linear subarrays being generally parallel to one another, said slots collectively forming a first layer of first antenna elements; and a second plane formed of a substantially flat surface which is spaced from and noncoplanar with said first plane and substantially parallel with said first plane, said second plane including a plurality of dipole elements, said dipole elements collectively forming a second layer of second antenna elements, said dipole elements arranged into a plurality of dipole linear subarrays which are interleaved with said slot linear subarrays, such that each of said slot linear subarrays is along a slot plane which is perpendicular with said first and second planes, and such that each of said dipole linear subarrays is along a dipole plane which is perpendicular with said first and second planes, and none of said slot planes being coplanar with or intersecting any of said dipole planes.

8. An antenna as in claim 7, wherein said electrically conductive material of said first plane forms a ground plane for said dipole elements of said second plane.

9. An antenna as in claim 7, wherein said dipole linear subarrays are transmitting elements and said slot linear subarrays are receiving elements.

10. An antenna as in claim 7, wherein each of said dipole subarrays comprises a microstrip transmission line running in a first direction and through which said dipole plane passes; and a plurality of said dipole linear subarrays running in a second direction transverse to said first direction.

11. An antenna as in claim 10, wherein each said slot subarray comprising:

a microstrip transmission line running in said first direction through which said slot plane passes; and a plurality of said slots, extending in said second direction transverse to said first direction.

12. An antenna as in claim 11 wherein said subarrays of slots receive vertically polarized information and said subarrays of dipoles transmit horizontally polarized information.

13. An antenna as in claim 10, wherein said second layer includes said dipole elements formed on a first sublayer and said microstrip transmission lines formed on a second sublayer different than said first sublayer.

14. An antenna as in claim 13, wherein each said slot subarray comprising:

a microstrip transmission line running in said first direction through which said slot plane passes; and a plurality of said slots, extending in said second direction transverse to said first direction.

15. An antenna as in claim 14, wherein said first layer includes said slots formed in a third sublayer and said transmission lines formed in a fourth sublayer.

16. An antenna as in claim 15, wherein said dipole elements are transmitting elements and said slot elements are receiving elements.

17. An antenna as in claim 15, further comprising a plurality of high power amplifiers adjacent said second layer and a plurality of low-noise amplifiers adjacent said first layer.

18. An antenna as in claim 17 wherein said first plane forms a ground plane for said second plane and feeds from said high power amplifiers to subarrays on said second plane are on a different side of said ground plane than feeds from said low noise amplifiers to said subarrays on said first layer.

19. An antenna as in claim 17 wherein each high power amplifier is coupled to one subarray.

20. An antenna as in claim 7, wherein each said slot subarray comprising:

a microstrip transmission line running in a first direction through which said slot plane passes; and a plurality of said slots, extending in a second direction transverse to said first direction.

21. An antenna as in claim 20, wherein said first layer includes said slots formed in a first sublayer and said transmission lines formed in a second sublayer different than said first sublayer.

22. An antenna as in claim 7 wherein said subarrays of slots receive information of a first polarization and said subarrays of dipoles transmit information in a second polarization different than said first polarization.

23. An antenna as in claim 7, wherein said slot linear subarrays operate at a first frequency and said dipole linear subarrays operate at a second frequency different than said first frequency.

24. A multiplanar slot and dipole antenna, comprising:

a first planar layer of conductive material;

a second layer defining a plane having x and y directions including a plurality of conductive parallel microstrip lines disposed over said first layer;

a third layer of conductive material including a plurality of columns of slot elements disposed over said second layer of microstrip lines;

a fourth layer defining a plane having x and y directions including a plurality of conductive parallel microstrip lines disposed over said third layer of slot elements;

a fifth layer including a plurality of columns of conductive dipole elements disposed over said fourth layer of microstrip lines;

a plurality of dielectric layers separating said layers;

wherein each said column of slot elements of said third layer is electromagnetically coupled to one of said microstrip transmission lines of said second layer, wherein each said column of dipole elements of said fifth layer is electromagnetically coupled to one of said microstrip transmission lines of said fourth layer and said third layer of conductive material, and wherein said microstrip lines of said fourth layer are interleaved with, and between said microstrip lines of said second layer in the X direction.

25. An antenna as in claim 24 wherein said third layers form a plurality of slot subarrays.

26. An antenna as in claim 25 wherein said fifth layers form a plurality of dipole subarrays.

27. An antenna as in claim 26 wherein said subarrays of slots receive information of a first polarization and said subarrays of dipoles transmit information in a second polarization different than said first polarization.

28. An antenna as in claim 24 wherein said microstrip lines of said fourth layer are situated between said columns of said slot elements in said third layer.

29. An antenna as in claim 24, wherein said slot elements operate at different frequencies than said dipole elements.

* * * * *